US005337934A

United States Patent [19]

Johnson et al.

[11] Patent Number: 5,337,934

[45] Date of Patent: Aug. 16, 1994

[54] FLIPOVER CARRYING DEVICE

[75] Inventors: Karen T. Johnson, Dallas, Tex.; Lori T. Adams, Fremont, Calif.; April D. Montgomery; John W. Montgomery, both of Duncanville, Tex.

[73] Assignee: Inventus, Inc., Dallas, Tex.

[21] Appl. No.: 900,615

[22] Filed: Jun. 18, 1992

[51] Int. Cl.[5] ..... A45F 4/02

[52] U.S. Cl. ..... 224/153; 224/197; 224/202; 224/901

[58] Field of Search ..... 224/151, 153, 197, 202, 224/209, 210, 211, 213, 215, 227, 228, 236, 259, 260, 266, 901, 203; 2/94, 102, 104; 190/109, 110, 111; 383/11

[56] References Cited

U.S. PATENT DOCUMENTS

| | | | |
|---|---|---|---|
| 2,340,964 | 2/1944 | Kassner | 224/209 X |
| 2,922,433 | 7/1961 | Roberge | 2/94 |
| 4,096,978 | 6/1978 | Noice | 224/8 R |
| 4,144,788 | 9/1978 | Zufich | 224/211 X |
| 4,483,469 | 11/1984 | Arisland | 224/151 |
| 4,555,812 | 12/1985 | Akers . | |
| 4,561,576 | 12/1985 | Louretal | 224/209 |
| 4,563,777 | 1/1986 | Park | 2/94 X |
| 4,601,067 | 7/1986 | Buonassissi | 2/102 |
| 4,642,815 | 2/1987 | Allen | 2/2 |
| 4,669,125 | 6/1987 | Allen | 2/2 |
| 4,669,127 | 6/1987 | Swanson | 2/94 X |
| 4,767,039 | 8/1988 | Jacobs | 224/151 |
| 4,904,351 | 6/1988 | Catenaccio . | |
| 4,940,173 | 7/1990 | Jacober | 224/151 |
| 5,063,614 | 11/1991 | McSheffery | 2/94 |
| 5,160,073 | 11/1992 | Bateman | 224/210 |
| 5,161,722 | 11/1992 | Hembre | 224/211 X |
| 5,165,111 | 11/1992 | Lieberman | 2/94 |
| 5,240,156 | 8/1993 | Sicotte et al. | 224/901 X |

FOREIGN PATENT DOCUMENTS

| | | |
|---|---|---|
| 818662 | 12/1974 | Belgium . |
| 258203 | 6/1912 | Fed. Rep. of Germany . |
| 8707977 | 7/1987 | Fed. Rep. of Germany . |

*Primary Examiner*—Glenn T. Barrett

*Attorney, Agent, or Firm*—John W. Montgomery

[57] ABSTRACT

A flipover carrying device for use by a wearer to carry possessions on the wearer's back and comprising a back panel supported adjacent a wearer's back, a moveable pouch supported adjacent the back panel in a first position and supportable adjacent the wearer's chest in a second position, a motion inhibitor interposed between the back panel and the pouch when the pouch is in the first position, and the pouch is attached in a position such that it is graspable by the wearer for moving the pouch from the first to the second position without removing the device.

21 Claims, 2 Drawing Sheets

FLIPOVER CARRYING DEVICE

TECHNICAL FIELD OF THE INVENTION

This invention generally relates to carrying devices, more particularly to pouches which are carried on a user's back, as part of a backpack or otherwise, and which may be flipped over the user's shoulder for convenient access in the front of the user's body.

BACKGROUND OF THE INVENTION

Over the years, numerous types, sizes, and styles of carrying backpacks, vests, and other packs have been made or proposed for use in conveniently carrying and storing various articles, such as clothing, books, camping gear, hunting gear, sports gear, baby items, and the like, on the user's back. Packs have been useful in all these contexts because they free the hands of the user for other activities and reduce bulk in the front of the user's body. However, users have always had to deal with the inconvenience of removing the backpack, vest or other pack when it was necessary to gain access thereto. Some backpack designers have attempted to minimize this problem by attaching smaller pockets to the front straps of the backpack. However, this solution provides easy access to only a limited amount of space (since the size of the pocket must relate to the size of the strap to which it is attached and to the size of the user's chest) and leaves the user with a front pocket that restricts movement and space for hand carrying of other items or of an infant. Consequently, there has been a need for a larger pouch which could be easily accessed from the front of the body, but which retains the convenience of greater carrying space on the back. Similarly, while vests and other clothing articles have utilized pockets and pouches for storage of items, such pockets and pouches have been located on the front and sides of the garment where they are accessible to the user, or the user has had to remove the garment to access storage on the back.

SUMMARY OF THE INVENTION

Advantageous results have been attained by one feature of the present invention which provides means by which the most frequently needed items can be accessed simply by flipping a pouch or pouches over the user's shoulder from the back to the front of the body. When resting on the user's back, the pouch or pouches are resting on top of a back panel. The back panel may be on the back of a garment (such as a jacket, vest or overalls) or the back of a customary backpack bag, and the pouches are secured to it by a strap and a hook-and-loop type attaching structure, such as VELCRO. The strap may be in the form of a second shoulder strap, extending back from the neck of the user to the pouch and positioned over the shoulder of the user, and over either of the conventional backpack straps, in the case of a backpack. The user merely reaches back to the strap and pulls it so that the VELCRO fastener releases and permits the pouch to be readily disengaged and to "flip" to the front of the user's body. The interior of the pouch can then be opened as it rests on the user's chest by separating a closure, such as snaps, zippers, or VELCRO, that seals its end. Once the user has finished using the pouch, it can be returned to its position on the user's back just by flipping it back over the shoulder. The strap and pouch are uniquely constructed so that the natural rearward hanging position aligns the hook-and-loop or VELCRO attachment structure. The VELCRO attachment rejoins when the pouch makes contact with the back of the larger backpack bag.

An additional feature of the invention provides small pull-off pockets secured to the sides of a main pack of a backpack with VELCRO, which also can be pulled away from the main pack for access and returned to place while the backpack remains in place on the user's back. These pockets permit small items such as money, clips, pens, small hunting accessories, or a baby bottle to be conveniently accessed by the user. The small pocket also can be attached to a VELCRO strip on the front of the backpack straps if desired, but can be removed from the front and reattached at the side of the backpack bag when front body space is needed.

A further feature of the invention extends a strap portion from the pouch, over the backpack shoulder strap and to the front of the user. This permits the pouch to be conveniently pulled and flipped over the user's shoulder. Repositioning the pouch to the back of the backpack also is facilitated. The backpack shoulder straps and the pouch access straps are conveniently overlapped and are held in position using mating hook-and-loop type fastener patches, such as VELCRO.

BRIEF DESCRIPTION OF THE DRAWINGS

The foregoing and other advantages and objects will be more fully understood with reference to the following detailed description of the invention, claims, and drawings in which like numerals represent like elements, and in which:

DETAILED DESCRIPTION OF THE INVENTION

Figure 1:
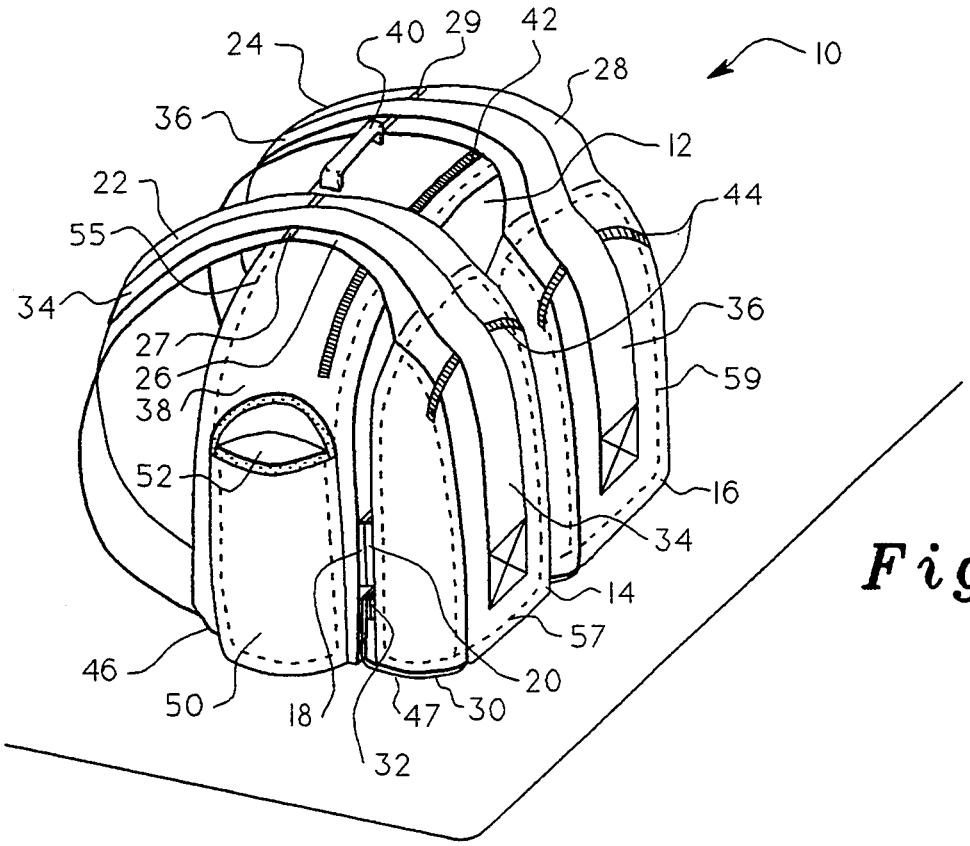
FIG. 1 is a schematic perspective view of one preferred embodiment of the invention.

FIG. 1 is a perspective view of a carrying device 10, such as a backpack 10 according to the present invention. It will be noted that throughout this application, the directions "left" and "right" are referred to with respect to the wearer's left and right, regardless of the position of the backpack 10 as it appears in the drawings. Also throughout this application, the term "backpack" will be used to mean any device for carrying possessions on the back of a person including but not limited to a conventional two shoulder strap-type backpack. For example, a pouch or a carrying bag supported on the back of a garment such as a vest, overalls, a jacket or a shirt is also intended to be included within the term "backpack."

Figure 2:
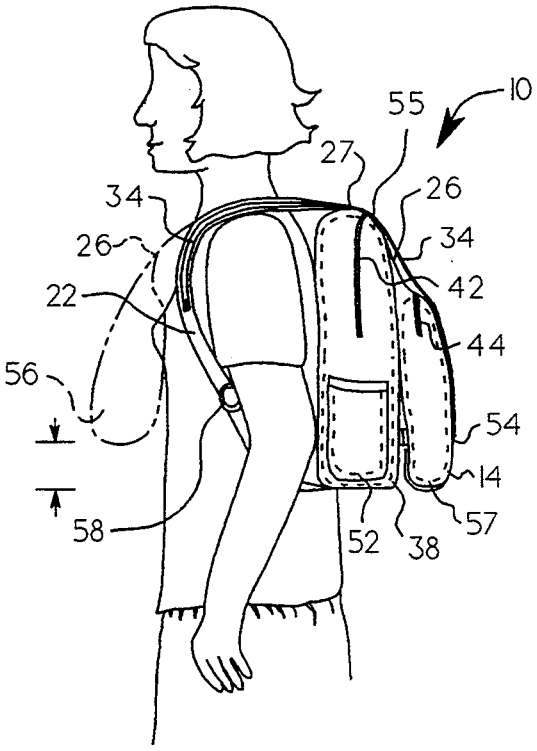
FIG. 2 is a side plan view of the flipover backpack of FIG. 1 shown in place on the back of a user and with the flipover front position of the pouches shown in phantom lines.

The backpack 10 includes a support panel 12, which may be positioned immediately adjacent to the wearer's back or spaced apart from but adjacent to the wearer's back (as shown in FIG. 2). For example, as in FIG. 1, there is a fixed carrying pack 38 interposed between the wearer and panel 12. A left enclosure or pouch 14 and a right enclosure or pouch 16 are positionable immediately adjacent the support panel 12. Interposed between the pouch 14 and the support panel 12 is a pouch fastener or stabilization patch 18 securely attached to the support panel 12 for releasable fastening of the pouch 14 to support panel 12. There is a corresponding pouch stabilization patch 20 securely attached on the underside of pouch 14.

In the preferred embodiment, the pouch stabilizing patch 18 and the corresponding patch 20 are correspondingly fastenable portions of hook-and-loop materials. For example, the "hook" portion of VELCRO material is sewed or glued to the fabric of support panel 12 and the "loop" portion of VELCRO material is sewed or glued to the fabric of pouch 14. While other releasable, fastenable patches might be suitable, VELCRO has been found to be advantageously suitable as a releasable, fastenable material for purposes of this aspect of the invention. It has also been found that while the loop portion and the hook portion may be placed on either side so long as the correspondingly appropriate type of material is on the opposite side, it is nevertheless advantageous to place the softer of the two materials on the underside of the pouch. As will be explained more fully below, the softer, less abrasive material is thus exposed toward the front when the pouch is flipped over.

The backpack 10 is provided with the shoulder support strap 22 on the left and strap 24 on the right. Straps 22 and 24 are designed for placement over the wearer's shoulders and attached to the upper portion of support panel 12. Pouch 14 is attached to the support panel adjacent the attachment of shoulder strap 22 at a flexible attachment means 26, such as a strap or extension of the pouch fabric attached to the panel 12 through permanent stitching 27. Similarly, the right pouch 16 is attached at a flexible attachment means 28, which is preferably connected to the panel 12 with permanent stitching 29.

Pouch 14 has an access opening 30. In the embodiment shown in FIG. 1, the opening 30 is preferably at or near the bottom of the pouch and is closed with a closure means 32. The closure means 32 is preferably a releasable, fastenable material composed of hook-and-loop mating material, such as VELCRO. A zipper, snaps, elastic, or the like releasable closure might also be used with varying degrees of convenience.

Figure 5:
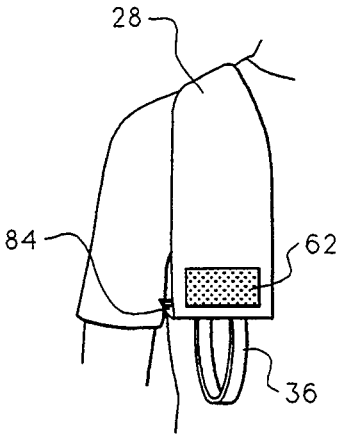
FIG. 5 is a front plan view of an alternative embodiment of a flipover pouch for use on the preferred embodiment of the present invention.
Figure 6:
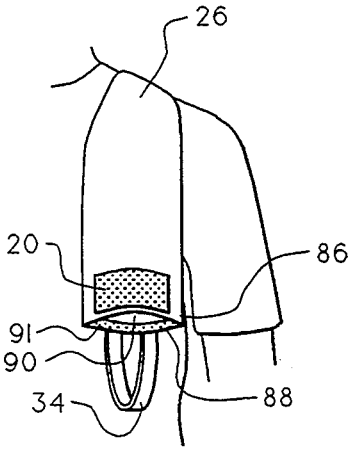
FIG. 6 is another alternative embodiment of a flipover pouch for use on the preferred embodiment of the present invention.

Alternative pouch construction might include a forward flap 31 (as shown at the wearer's left in FIG. 3), an elastic envelope without a flap 78, (as shown at the user's right in FIG. 3), a reverse flap 84 (as shown in FIG. 5), an end-to-end closure 91 without a flap (as shown in FIG. 6), a center opening flap construction or other selectively closeable constructions which allow for attachment to a stabilization patch. The pouch can be flipped over the user's shoulders, for example, by grabbing attachment means 26 or 28. However, as will be explained more fully with reference to FIG. 7, the backpack can be advantageously constructed with left pull strap 34 and right pull strap 36 to facilitate easy access.

In the preferred embodiment, the support panel 12 is the rearmost panel of a carrying pack 38. The backpack may also be advantageously provided with a handle 40 to allow the main pack 38 and the pouches 14 and 16 to be conveniently hand carried, much as an ordinary satchel, when not on the wearer's back.

In the top of main pack 38, there is a top closeable access 42, which may be held closed with any known fastening and opening means, but is preferably a zippered opening 42. Advantageously, each pouch can also be provided with a closeable top pouch access 44, which may be a zippered opening. Both of the top access openings 42 and 44 provide convenient use of the backpack as a satchel with a plurality of compartments, when not being transported on the wearer's back.

It is advantageous that the main pack 38 and the pouches 14 and 16 are uniquely constructed, such that their normal hanging positions are aligned along their respective bottoms 46 and 47, so that placement on a floor 48 or other flat surface 48 provides stability. Thus, the inventive backpack construction reduces the tendency of ordinary backpacks to topple over. This has been found to be advantageous, for example, where the flipover backpack, according to the present invention, is used as a "baby bag" for carrying various items for attending to infants, babies and small children. The ability to set the pack stably on a surface allows the guardian of a child to access both the pouches and the main pack in a convenient fashion when the pack is removed without the backpack toppling over. However, as will be explained more fully below, the pouches of the backpack are also especially convenient for use without taking it off.

An auxiliary side pouch 50 may also be provided on the side of the main pack 38 to provide additional storage area. Auxiliary side pouch 50 is advantageously provided with a removable waterproof liner 52, which can be used for placing damp items inside the removable liner without soaking into the backpack material. Such uniquely removable waterproof liners can also be used in other compartments of the backpack, such as within the main compartment 38, or within pouches 14 and 16. Such a waterproof liner will provide the additional advantage of insulating the material of the pack from damp or soiled items, such as baby diapers and the like, and can be conveniently removed. Such liners may be disposable, but are preferably washable, as by tossing them into an automatic washer. Thus, the cleanliness and freshness of the backpack is preserved in an environmentally and economically sound manner.

FIG. 2 is a side plan view of a wearer with an inventive backpack 10 in a first position 54 shown in solid line, which is the normal carrying position for walking, standing or other activities. The VELCRO patches advantageously and automatically inhibit the motion of the pouches relative to the backpack. When the items carried in the pouches 14 and 16 are required to be accessed, the pouches can be flipped into the front of the wearer as shown with phantom lines in a second position 56, which is a convenient pouch access position. In the second or front position, the pouches are supported by permanent attachment straps 26 and 28. Also shown in FIG. 2 is a shoulder strap adjustment 58, which advantageously allows the wearer to adjust the length of the straps to the length of the shoulder straps 22 and 24 for comfortable carrying. It will be noted also that waist belts or hip support means (not shown) could also be attached for additional stability and carrying comfort if desired.

Figure 3:
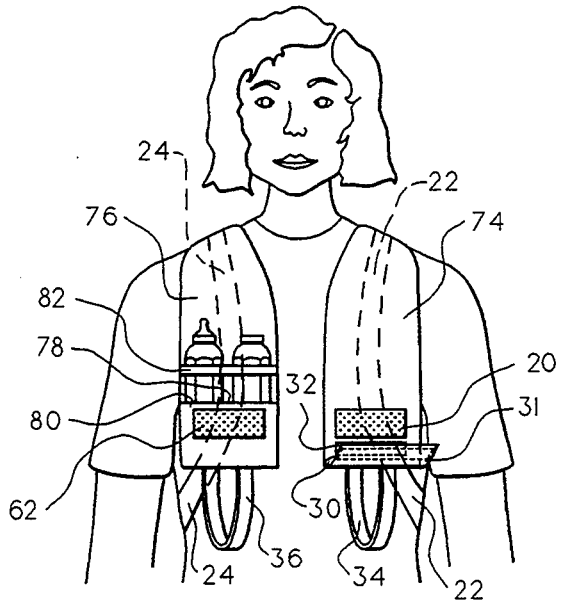
FIG. 3 is a front view of the flipover pouches in which alternate embodiments of the left and right pouches are shown flipped over to the front of the user for access.
Figure 4:
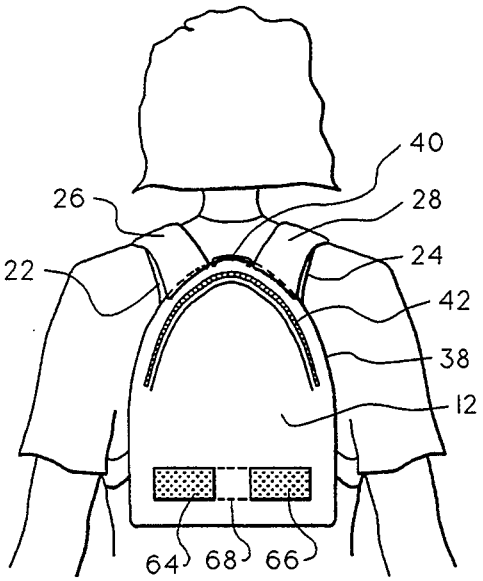
FIG. 4 is a rear plan view of the flipover pouches flipped to a front position showing the backpack construction for attachment of the flipover pouches.

FIG. 3 is a plan view which shows two (2) alternative embodiments of pouches according to the invention in a front position for easy access to the contents of those pouches. In this view, the releasable fastener patch or panel 20 for the left pouch 14 and patch or panel 62 for the right pouch 16 are shown sewn onto the front panels of pouches 14 and 16, respectively. It will be noted with reference to FIGS. 3 and 4 together that the position of the releasable fastener patches 20 and 62 are designed to correspond to the position of corresponding fastener or pouch stabilization patches 64 and 66 on the support panel 12, as shown in FIG. 4 at the rear of main backpack compartment 38. The releasable fastener patches are preferably positioned toward the lower portion of the pouches and the support panel 12 to give maximum leverage for stability, this being accomplished by spacing the releasable fastener a maximum distance from the permanent attachment stitching 27 and 29 thereabove. It will also be noted that the patch portions 64 and 66 may be constructed of a continuous or interconnecting panel, as shown in phantom lines at 68. The convenience of such a construction with a single patch may be of greater advantage than the costs of additional material, as opposed to two separate patches, and may also facilitate rapid reattachment of the pouches.

In certain circumstances, it has also been found to be advantageous for purposes of convenient access to the main backpack 38 to position the left permanent pouch attachment 27 and the right permanent pouch attachment 29 below the main pack access opening 42. (Not shown) In particular, where a backpack is to be removed frequently and placed on a surface, having all compartments accessible without movement of the pouches to their frontal position may be beneficial. Structural integrity is believed to be enhanced with both shoulder support straps and pouch support straps attached on the same side of access opening 42 as shown in FIGS. 1 and 3.

Referring again to FIG. 3, one preferred embodiment of pouch 14 is depicted at the wearer's left side, having a front panel 74 which completely encloses the pouch compartment. An openable portion 30 is covered, when access is not required, with a flap 31 held in position, as indicated previously with a strip of hook-and-loop material 32. It will be noted that the positions of hook-and-loop material 32 is below the releasable attachment panel or patch 20. It can be advantageous, for construction purposes, to have a vertically elongated releasable attachment panel 20 which serves both as a mating surface for patch 64 on support panel 12 and also serves as the mating portion for a narrow strip of VELCRO material 32 securely attached on the inside end of flap 31.

Shown at the right side of the wearer in FIG. 3 is an alternative pouch construction in which there is a back panel 76 having a pocket 78 formed at the lower portion thereof. In this embodiment of a pouch, according to the present invention, the VELCRO attachment patch 62 is on the front of pocket 78. The pocket 78 can be advantageously formed with an elastic upper border 80 to provide closure tension for items placed within the pocket. Further, for specialized carrying of elongated items such as bottles or baby diapers, an elastic support band 82 may also be formed on back panel 76. In the preferred embodiment, support band 82 is formed with an elastic material or fabric spaced above pocket 78, thereby holding elongated items in position, for secure carrying, yet easy access.

With reference to FIG. 5, another alternative construction of a pouch 14 is shown, in which there is a reverse direction pouch flap 84. Such a reverse direction pouch flap 84 is found to be advantageous for purposes of providing secure detachable engagement between the corresponding VELCRO panels 20 and 64. The accessibility into the pouch is reduced slightly, but is objectionably hindered when the pouch is flipped to its frontal position.

FIG. 6 shows another alternative preferred pouch construction in which a front panel 86 and a back panel 88 are of equal lengths, so that they are connected or sewn along their sides. Both panels 86 and 88 end evenly at an access opening 90. The access opening 90 can be closed with corresponding strips of VELCRO, a zipper, or other openable fastening means 91.

Figure 7:
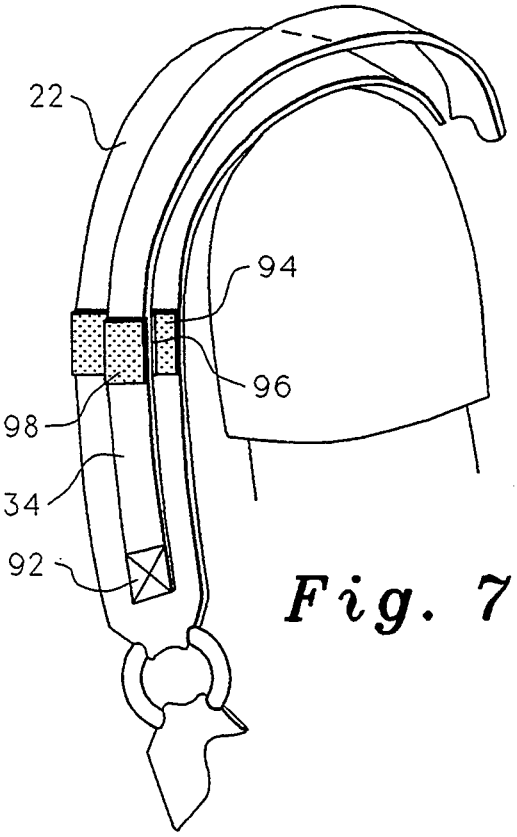
FIG. 7 is a partial view showing the unique double strap construction for convenient flipover access to the pouch according to the preferred embodiment of the present invention.

FIG. 7 shows a partial portion of a support strap 22 and a flipover pull strap 34 in a perspective view. The preferred construction is shown, in which the pull strap 34 is attached in the front toward a lower portion of shoulder strap 22 at a secure attachment area 92, such as a strong fabric stitching attachment 92. The pull strap 34 is preferably attached to the back of the pouch toward the lower end thereof, so that pulling the strap 34 causes the VELCRO patches 20 and 64 to be released. Upward on shoulder strap 22 from the attachment area 92, a VELCRO stabilizer pad 94 is advantageously provided attached to and facing outwardly from strap 22. A corresponding VELCRO stabilizer connection pad 96 is attached to and facing inwardly from the underside of flipover pull strap 34. Thus, when the backpack pouch 14 is placed in its back carrying position, the flipover strap 34 can be pushed against the shoulder strap 22 to engage VELCRO pads 92 and 96. The pull strap is thereby maintained in position so that it does not fall off of the user's shoulder or otherwise flop down and get in the way.

It has also been found that in certain situations, it may be desirable to provide an accessory attachment pad 98 on the exterior of shoulder strap 22, or pull strap 34, by which items such as bottles, rattles, pacifiers, etc. can be applied with a corresponding loop-and-hook or VELCRO pad 98 to thereby hold them on the strap. Such an accessory attachment loop-and-hook pad 98 can beneficially be formed of the same loop material or the hook material as the strap stabilizer pad 94, and can be designed to be immediately adjacent to the pad 94 to thereby benefit by and enlarged area of the accessory attachment patch of loop-and-hook or VELCRO material.

While the invention has been disclosed in connection with preferred embodiments, it is not intended to be limited to the specific embodiments as disclosed, but, to the contrary, the scope is intended to cover alternatives and equivalents as may be within the scope of the claims below.

What is claimed is:

1. A backpack to be worn by a person having a front and a back for carrying possessions comprising:

(a) a back support panel adapted to be positioned adjacent the person's back when the backpack is worn;

(b) a pouch attached to the panel having a first supported position adjacent the person's back;

(c) a motion inhibitor attached to the back support panel at a position on the back support panel and the pouch for inhibiting motion of the pouch in the first supported position, wherein the motion inhibitor comprises:
(i) a patch of hook-and-loop material attached to the back support panel; and
(ii) a mating patch of hook-and-loop material attached to the pouch such that the mating patches of hook-and-loop material are aligned for releasable fastening when the pouch is in the first supported position;
(d) means attached to the pouch, accessible by the person without removing the backpack being worn, for non-detachably moving the pouch to a second supported position adjacent the person's front while the back support panel remains adjacent the person's back; and
(e) first opening formed in the pouch for allowing access into the pouch from the second supported position.

2. A backpack as in claim 1 wherein the patches of hook-and-loop and mating hook-and-loop material comprise patches of VELCRO.

3. A backpack as in claim 1 wherein the first opening formed in the pouch is a selectively closeable opening.

4. A backpack as in claim 1 further comprising a removable waterproof liner sized for insertion into the first pouch opening.

5. A backpack as in claim 1 wherein the first opening of the pouch comprises:
(a) opposed lower edges of the pouch, each edge having an interior surface and an exterior surface and forming a hollow opening between the interior surfaces;
(b) a flap having an inside and extending from one of the opposed lower edges a distance sufficient to bend partially up the exterior surface of another of the opposed lower edges; and
(c) mating VELCRO strips, one attached to the inside of the flap and another attached to the exterior of the other of the opposed lower edges so that the mating VELCRO strips fastenably engaged when the opening is covered by the flap.

6. A backpack as in claim 5 wherein the flap bends forward, relative to the person's front and back, when the pouch is in the first position.

7. A backpack as in claim 5 wherein the flap bends rearward, relative to the person's front and back, when the pouch is in the first position.

8. A backpack as in claim 1 wherein:
(a) the pouch further comprises a front panel and a back panel of the pouch attached along a first and a second side to form a tube therebetween, such that the front and back panels of the pouch are substantially coterminous at a lower end of the pouch; and
(b) the first opening of the pouch comprises mating closure material attached along the substantially coterminous front and back panels of the pouch so that the front and back panels of the pouch are releasably held together thereby.

9. A backpack as in claim 8 wherein the mating closures material comprises mating VELCRO strips.

10. A backpack as in claim 8 wherein the mating closure material comprises opposing sides of a zipper.

11. A backpack to be worn by a person having a front and a back for carrying possessions comprising:
a shoulder strap;
a back support panel attached to the shoulder strap and held thereby adjacent the person's back;
a pouch attached to the backpack having a first supported position located adjacent the back support panel; means attached to the pouch; accessible by the person without removing the backpack being worn, for non-detachably moving the pouch to the second supported position adjacent a person's front while the back support panel remains adjacent the person's back, said means for non-detachably moving the pouch including
a pouch support strap attached to the back panel and the pouch for supporting the pouch in the first and second positions and
a pull strap attached to the pouch and the shoulder strap so that it is accessible from the person's front for pulling the pouch from the first to the second position; and
a first opening formed in said pouch for allowing access into the pouch when said pouch is in said second supported position.

12. A backpack to be worn by a person having a front and a back for carrying possessions comprising:
a main pack supportable by shoulder straps overlaying the person's back;
a back support panel located on the main pack;
a pouch attached to the backpack having a first supported position on the back support panel; means attached to the pouch, accessible by the person without removing the backpack being worn, for non-detachably moving the pouch to a second supported position adjacent a person's front while the back support panel remains adjacent the person's back;
a motion inhibitor attached to the back support panel for releasably holding the pouch in the first position and for releasing the pouch when it is moved to the second position and
a first opening formed in said pouch for allowing access into the pouch when said pouch is in said second supported position.

13. A backpack as in claim 12 wherein the motion inhibitor comprises:
(a) a first patch of VELCRO affixed to the back panel of the main pack; and
(b) a second patch of VELCRO, of a type for releasable mating engagement with the first patch of VELCRO, attached to the pouch and aligned for engagement with the first patch of VELCRO when the pouch is in the first position.

14. A backpack as in claim 13 further comprising:
(a) a top and a bottom portion of the main pack;
(b) a handle affixed to the top portion of the main pack;
(c) a bottom of the pouch; and
(d) wherein the main pack bottom and the pouch bottom terminate substantially aligned when the pouch is in the first position so that the pouch and main pack can be set stably on a substantially flat support surface.

15. A backpack as in claim 14 further comprising:
a selectively closeable top of the main pack; and
a second closeable opening in the pouch allowing access into the pouch when it is in the first position supported at the user's back.

16. A backpack as in claim 12 further comprising a removable waterproof liner sized for insertion into the main pack.

17. A backpack as in claim 12 further comprising a removable waterproof liner sized for insertion into the pouch.

18. A backpack as in claim 12 further comprising a detachable side pocket attached to a side of said main pack.

19. A backpack as in claim 18 further comprising a waterproof liner sized for insertion into the side pocket.

20. A backpack to be worn by a person having a front and a back for carrying possessions comprising:

(a) a pouch movably attached to the backpack, said pouch being located on a back panel of said backpack in a first supported position adjacent the person's back;

(b) means, accessible by the person without removing the backpack being worn, for non-detachably moving the pouch to a second supported position adjacent the person's front while the back support panel remains adjacent the person's back;

(c) a first opening formed in the pouch for allowing access into the pouch from the second supported position;

(d) wherein the pouch includes an envelope formed with three sides closed and the first opening is in an open side, said first opening being accessible only when said pouch is in said second supported position; and (e) wherein the first opening of the pouch comprises an elastic band around the first opening so that the opening is held closed by the elastic band.

21. A backpack as in claim 20 wherein the pouch further comprises a support band attached to the pouch spaced above the first opening of the pouch so that elongated objects placed in the envelope and extending upward through the first opening can be held at an upper portion by the support band.

* * * * *